United States Patent [19]

Gressette, Jr.

[11] Patent Number: 4,525,070

[45] Date of Patent: Jun. 25, 1985

[54] ROTARY MIXING APPARATUS

[76] Inventor: Tatum W. Gressette, Jr., Highway 601 North, Box 318, St. Matthews, S.C. 29135

[21] Appl. No.: 483,289

[22] Filed: Apr. 8, 1983

[51] Int. Cl.[3] ..... B01F 9/06; B28C 5/22

[52] U.S. Cl. ..... 366/18; 366/26; 366/57; 366/63; 366/189; 366/228; 414/657

[58] Field of Search ..... 366/18, 26, 54, 57, 366/60, 61, 62, 63, 141, 220, 228, 189, 192, 193; 191/12.2 R, 12.2 A; 414/657

[56] References Cited

U.S. PATENT DOCUMENTS

| | | | |
|---|---|---|---|
| 531,486 | 12/1894 | Upton | 212/160 X |
| 864,451 | 8/1907 | Davis | 366/26 |
| 914,291 | 3/1909 | Leake | 366/57 X |
| 973,543 | 10/1910 | Muller . | |
| 1,065,607 | 6/1913 | Hennessy . | |
| 1,349,285 | 8/1920 | Lynch | 366/57 |
| 1,423,889 | 7/1922 | Townsend | 191/12.2 A |
| 1,562,872 | 11/1925 | Davis | 414/909 X |
| 1,734,981 | 11/1929 | Philips | 366/57 |
| 2,349,284 | 5/1944 | Kinzelman | 254/361 |
| 2,409,752 | 10/1946 | Goodwin | 414/595 X |
| 2,416,746 | 3/1947 | Gavin . | |
| 2,625,344 | 1/1953 | Flansburgh | 191/12.2 A X |
| 2,903,526 | 9/1959 | Mattox, Sr. | 191/12.2 A X |
| 3,091,369 | 5/1963 | Sackett, Sr. . | |
| 3,208,735 | 9/1965 | Wolff . | |
| 3,218,044 | 11/1965 | Domenighetti | 366/18 |
| 3,244,411 | 4/1966 | Kühner | 366/18 |
| 3,344,877 | 10/1967 | Dietert . | |
| 4,125,332 | 11/1978 | Schmednecht . | |
| 4,242,036 | 12/1980 | Slaght | 414/909 X |
| 4,339,204 | 7/1982 | Placzek | 366/18 |

FOREIGN PATENT DOCUMENTS

| | | | |
|---|---|---|---|
| 440217 | 2/1927 | Fed. Rep. of Germany | 366/26 |
| 296940 | 5/1932 | Italy . | |
| 2945 | of 1915 | United Kingdom | 366/57 |
| 988786 | 4/1962 | United Kingdom | 366/18 |
| 562259 | 8/1977 | U.S.S.R. . | |

*Primary Examiner*—Philip R. Coe
*Assistant Examiner*—Frankie L. Stinson
*Attorney, Agent, or Firm*—Bell, Seltzer, Park & Gibson

[57] ABSTRACT

A mixing apparatus for dry or wet ingredients is disclosed, which comprises an upwardly inclined trackway, and a mixing container mounted for rolling movement along the trackway. The trackway includes a scale at the lower end which permits the container and its contents to be weighed, and so that predetermined amounts of a number of ingredients may be loaded into the container. A power system is provided for pulling the container upwardly along the trackway, and such that the container is subjected to a rotary motion for mixing the ingredients, and a simultaneous linear transport to an elevated position. The container includes unique internal mixing vanes which facilitate mixing of the ingredients during rotation of the container, and which also permit substantially all of the mixed ingredients to be freely discharged by gravity at the elevated discharge location.

10 Claims, 8 Drawing Figures

ROTARY MIXING APPARATUS

The present invention relates to an apparatus for weighing, mixing, and transporting a mixture of dry granular or wet materials, and which is characterized by simultaneous rotary mixing and linear transport of the materials.

In the blending and mixing of dry granular ingredients, such as fertilizers, clays, granules or the like, it is conventional to utilize a blending system which includes a tower having a rotary mixer mounted at an elevated location so as to permit the mixed contents to be discharged by gravity from the mixer into an underlying truck bed or the like. A conveyer system is provided for lifting the ingredients into individual bins in the tower above the rotary mixer, and the rotary mixer includes a door in its peripheral wall which is adapted to admit the ingredients from the bins when the door is in the up position. Also, the mixer is mounted on load cells to permit the contents to be weighed. In use, the individual ingredients are conveyed upwardly into the separate storage bins, and the desired amounts of the separate ingredients are individually discharged from the bins into the rotary mixer, with the amount of each ingredient being controlled by the indicated weight of the mixer. When the proper amount of each ingredient is in the rotary mixer, the door of the mixer is closed and the mixer is rotated about a horizontal axis. After the appropriate mixing time, the mixer is stopped with the door in the down position, so that upon opening of the door, the mixed ingredients drop into the underlying truck bed.

While mixing tower systems of the above type are commonly used in the fertilizer industry, it will be appreciated that they are quite expensive in view of the heavy structural framework required for supporting the elevated bins and mixer. Thus such tower systems are relatively permanent structures, and they cannot be readily moved from place to place. Also, present tower systems involve a relatively large number of components, including elevating conveyors, bins, a plurality of motors, and bearings for rotatably supporting the mixer, all of which are expensive and subject to mechanical breakdowns. Still further, rotation of the filled mixer on the sensitive weighing mechanism can result in damage to the mechanism.

In an attempt to avoid the expense and other disadvantages of the tower mixing systems, it has also been proposed to utilize a ground system, wherein the various components are located at ground level. This system typically includes a weigh hopper which is adapted to be loaded from a payloader, a conveyor for transporting the materials from the weigh hopper to a mixer, and an inclined second conveyor for carrying the materials from the mixer into a truck bed. As will be apparent however, a ground system of this type also includes a large number of components, and it has a relatively large power requirement.

It is accordingly an object of the present invention to provide a rotary mixing apparatus which is adapted to mix dry granular or wet materials, and which is inexpensive to construct and utilize, thus rendering the apparatus suitable for use on small farms, in underdeveloped countries, and the like.

It is another object of the present invention to provide a mixing apparatus of the described type which is simple and reliable in operation, which requires few components and little maintenance, and which lends itself to a single input energy source.

It is a more particular object of the present invention to provide a mixing apparatus wherein the materials are weighed, mixed, and transported in the same container, thereby reducing the number of components and avoiding the need for conveyors between the components.

It is also an object of the present invention to provide a mixing apparatus which may be readily disassembled and moved, so that the apparatus may be moved from place to place to follow crop seasons, construction or paving projects, and the like.

It is still another object of the present invention to provide a mixing container having internal mixing blades for facilitating the mixing of the materials therein during rotation of the container, and wherein the blades do not significantly interfere with the free discharge of the materials upon opening of the door of the container.

These and other objects and advantages of the present invention are achieved in the embodiment illustrated and described herein, by the provision of a trackway comprising a pair of parallel, laterally spaced apart rails, and with the trackway defining a receiving end portion and a discharge end portion. A mixing container is provided which includes a peripheral outer wall and opposite parallel end walls, and a door positioned in the peripheral outer wall for receiving and discharging the ingredients. An axle is mounted to each of the end walls, and a wheel is fixed to each axle for supporting the container for rotational movement along the rails of the trackway. In addition, weighing means is operatively connected to said receiving end portion of the trackway for permitting the container and its contents to be weighed. Further, power means is provided for moving the container along the trackway. Thus in use, the container is adapted to be filled with a plurality of materials while located on the receiving end portion, and with the amount of each added material being weighed. The container may then be rolled along the tracks to effect concurrent mixing and transport of the materials, and the mixed ingredients may then be discharged upon the container reaching the discharge end.

In the preferred embodiment, the trackway is inclined upwardly from the receiving end to the discharge end, and such that the container is elevated at the discharge end to facilitate discharge into an underlying truck bed or the like. Also, the container preferably also includes internal mixing vane means in the form of a plurality of flat blades mounted in spaced relation to the inside surface of the container outer wall, and such that the blades do not interfere with the free discharge of the materials through the door, nor do the blades retain any appreciable amount of the mixed materials in the container upon such discharge.

Some of the objects and advantages of the invention having been stated, others will appear as the description proceeds, when taken in connection with the accompanying drawings, in which FIG. 1 is a top plan view of a mixing apparatus embodying the features of the present invention;

Figure 1:
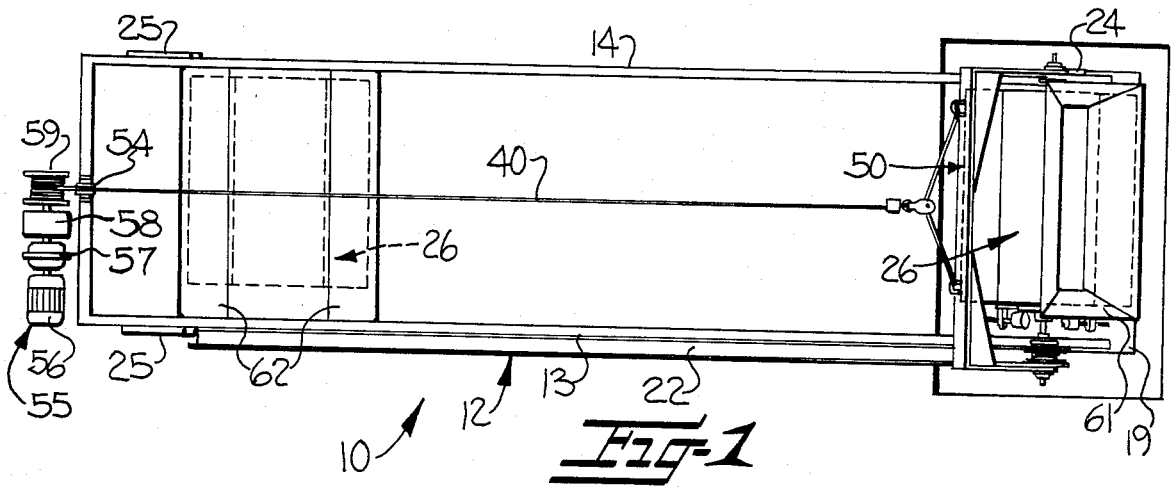
Figure 2:
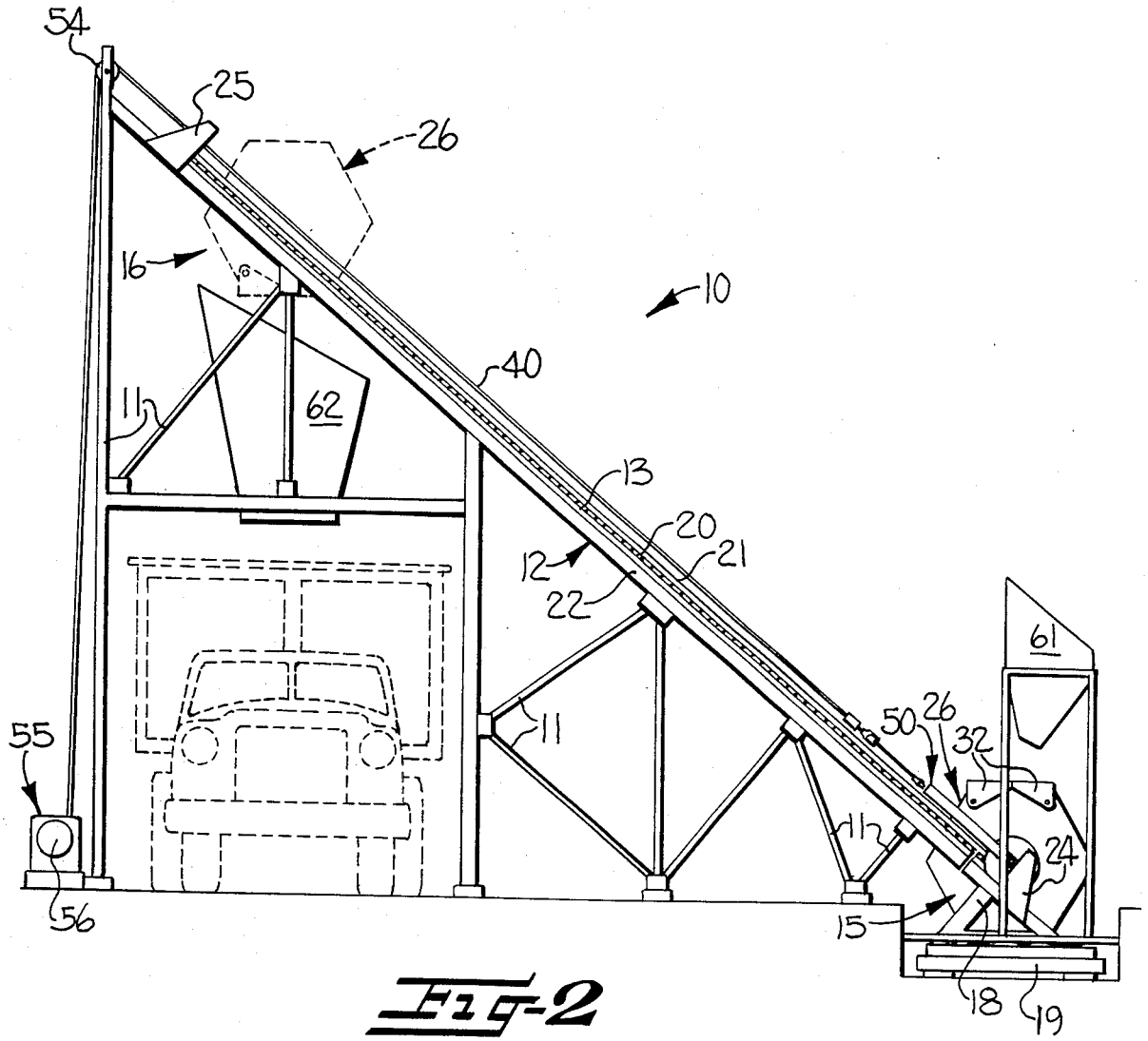
FIG. 2 is a side elevation view of the mixing apparatus shown in FIG. 1.

Referring more particularly to the drawings, FIGS. 1 and 2 illustrate the overall structure of the mixing apparatus 10, which includes a bolted truss supporting framework 11. As will be apparent, the framework 11 may be assembled and disassembled relatively easily, and it includes an inclined trackway 12 along its upper side. The trackway is composed of a pair of parallel laterally spaced apart rails 13, 14, and the trackway defines a receiving end portion 15 on the right as seen in FIGS. 1 and 2, and an elevated discharge end portion 16 on the left. The receiving end portion of the trackway is physically unconnected to the remaining portions of the trackway, and it is mounted on a separate portion 18 of the framework, which in turn is entirely supported on a suitable scale 19. In the illustrated embodiment, the trackway 12 is inclined upwardly at an angle of about 40°. It will be understood however that depending upon the particular operating conditions, a greater or lesser inclination may be utilized.

The upper edge of each rail mounts a toothed rack 20, which in the illustrated embodiment is in the form of a chain which extends along the length of each rail. A guide plate 21 extends along the inside of each rail, and a U-shaped trough 22 extends along the outside of the rail 13. Also, a pair of stop brackets 24 are mounted adjacent each rail at the receiving end portion for the purpose described below, and a similar pair of stop brackets 25 are mounted adjacent each rail at the discharge end.

Figure 4:
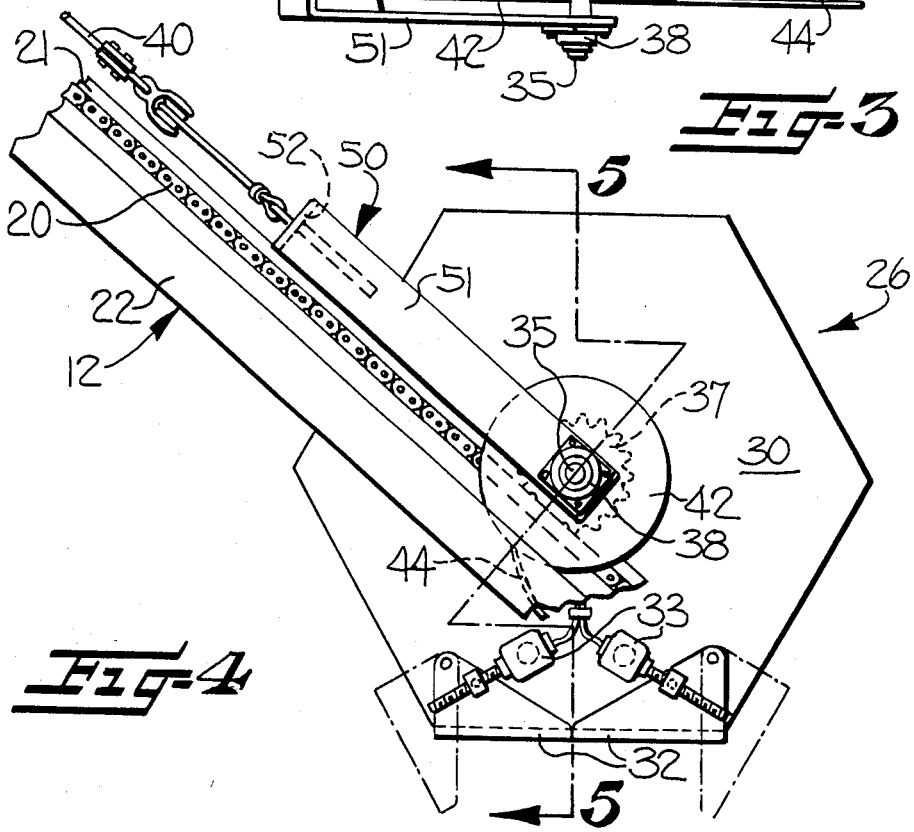
FIG. 4 is a side elevation view of the mixing container.
Figure 5:
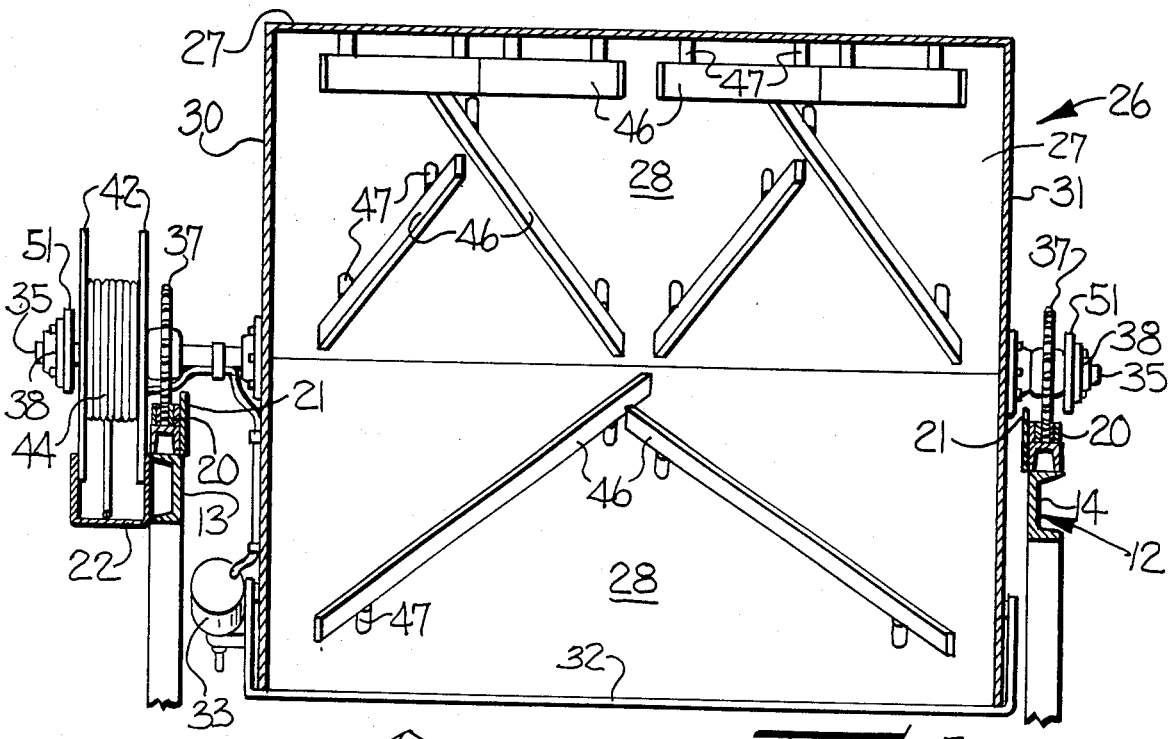
FIG. 5 is a sectional side view of the container taken substantially along the line 5—5 of FIG. 4.
Figure 6:
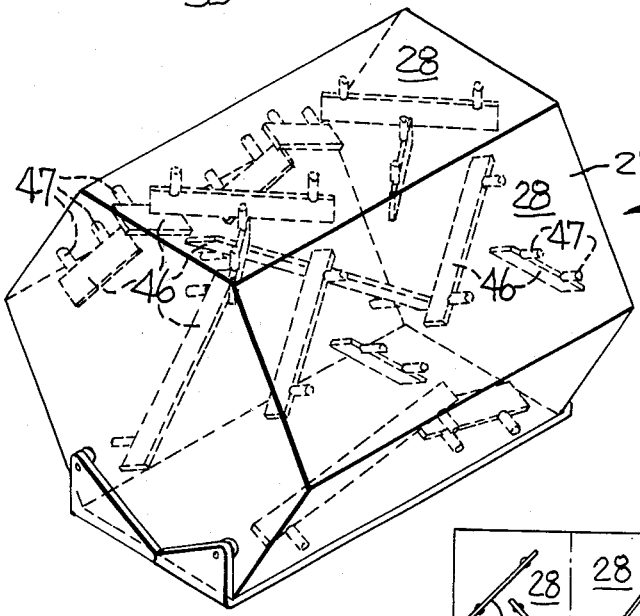
FIG. 6 is a perspective view of the container and illustrating the internal mixing blades of the container.

The apparatus 10 further includes a mixing container 26 which is adapted to receive the materials to be mixed. The illustrated container 26 includes a peripheral outer wall 27 composed of six flat wall sections 28 disposed in a hexagonal arrangement in cross section, and with the sections thus defining a horizontal axis. The ends of the container are closed by two end walls 30, 31, and one of the peripheral side wall sections comprises a door 32 which may be designed for either manual or powered opening and closing. As illustrated, the door 32 is in the form of two pivotal clam shells, which are each opened and closed by an electric motor 33 mounted on one of the end walls. FIG. 4 illustrates the doors in their closed position in solid lines, and in their opened position in dashed lines.

The mixing container 26 further includes an axle 35 fixedly mounted to each end wall and extending along the horizontal axis of the container. Each axle 35 in turn mounts a pinion gear wheel 37 which is sized and positioned to operatively engage the toothed rack 20 on the adjacent rail of the trackway, and so that the container may roll along the trackway with the pinion wheels engaging the toothed rack to prevent slippage therebetween. As will be apparent, the diameter of the pinion wheel 37 may by design be varied to increase or decrease the number of revolutions of the container during its length of travel. Also, it will be seen that the guide plates 21 prevent derailment of the pinion wheels 37 with the respective toothed racks 20.

Each of the axles 35 also rotatably mounts a bushing 38, to which the pulling cable 40 is attached in the manner further described below. Also, one axle fixedly mounts a reel 42 which is positioned to overlie the trough 22 and is adapted to have a length of flexible conduit wound thereupon for transmitting electrical power, hydraulic fluid or the like to the container. As illustrated, the reel mounts an electric cable 44 which is operatively connected to the motors 33 for the doors.

Figure 7:
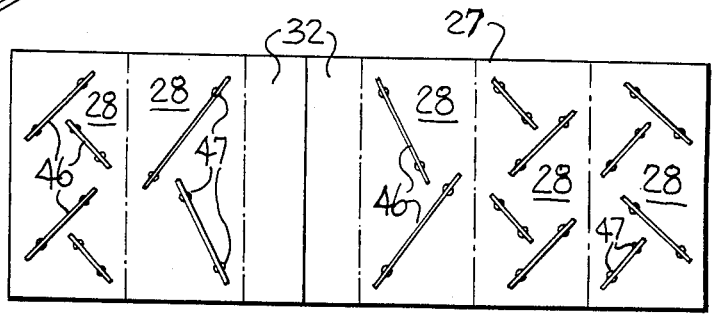
FIG. 7 is a view of the interior of the mixing container projected onto a flat surface.

The interior of the container mounts a plurality of mixing vanes for facilitating the mixing of the ingredients upon rotation of the container. The vanes are in the form of flat plates 46 which are supported in spaced relation from the internal surface of the side wall sections 28 by posts 47. The plates may assume a variety of patterns, with an exemplary pattern being illustrated in FIG. 7. In the illustrated mounting arrangement and pattern, all of the wall sections but the door mount at least one pair of the flat plates. Also, the plates of each pair are separated and oppositely inclined with respect to the axial direction of the container. This arrangement is advantageous in that it permits substantially all of the ingredients to drop through the door during the discharge operation, without any significant amount of the ingredients being retained behind the plates.

The apparatus further includes drive means for moving the container 26 upwardly along the trackway 12, and for permitting the container to roll downwardly therealong. The drive means includes a rigid D-ring 50 fixed to the axles 35 of the container. More particularly, the D-ring 50 is composed of parallel side arms 51 and a lateral connecting 52 arm which is disposed parallel to the central axis of the container. The side arms 51 are fixed to respective ones of the bushings 38, so that the arms 51 are rotatable with respect to the axles 35.

Figure 3:
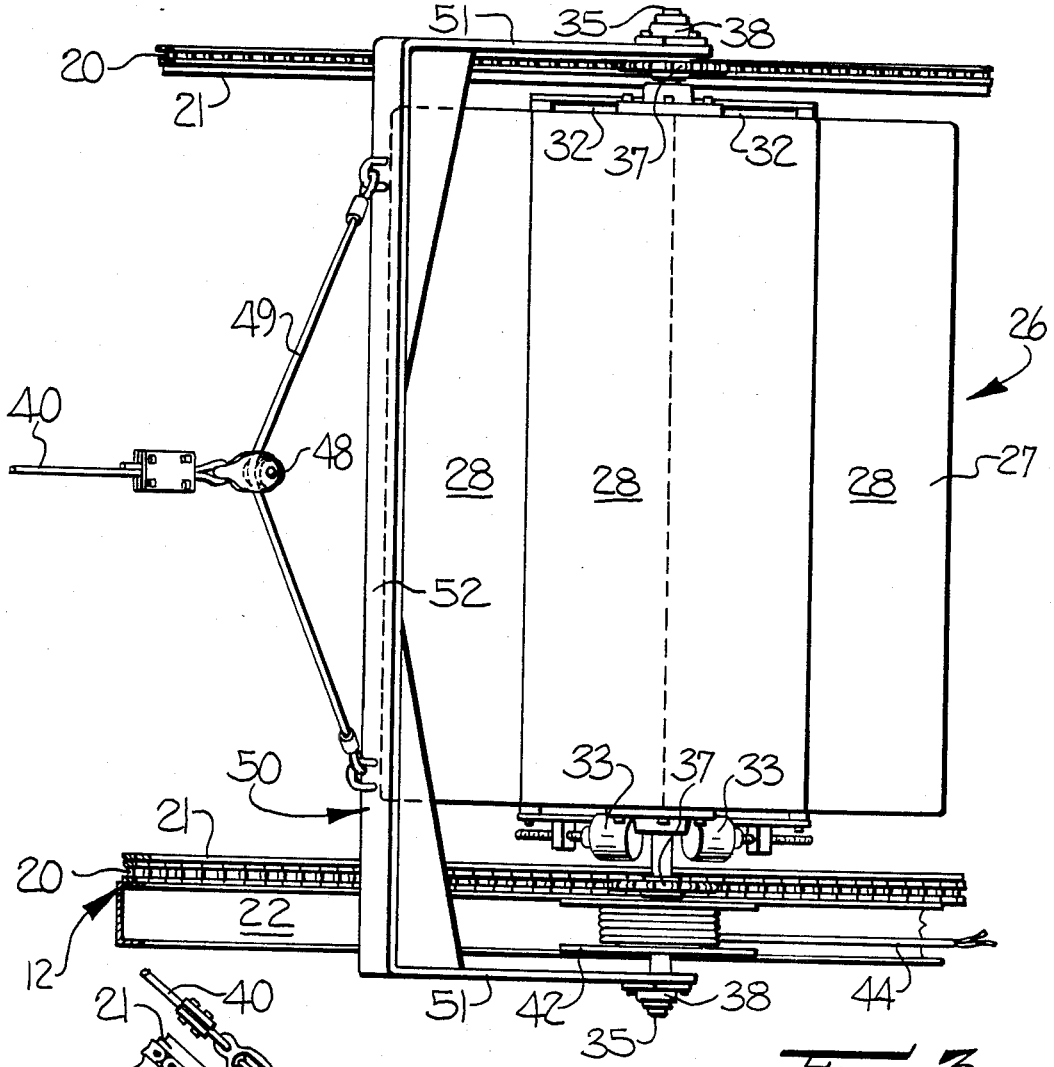
FIG. 3 is a fragmentary top plan view of the mixing container of the apparatus.

The drive means further includes the cable 40 which is affixed to the central portion of the lateral connecting arm 52 by means of the pulley 48 fixed to the end of the cable 40, and a line 49 joined at spaced points to the arm 52 of the D-ring, note FIG. 3. The pulley 48 is free to roll along the line 49, so that the pulling force is automatically centered with respect to the container. In addition, the force exerted by the cable 40 will be transmitted through the arms 51 to each of the axles 35, and the forces to the axles will be equalized to maintain the container centered along the trackway and avoid the canting thereof.

Figure 8:
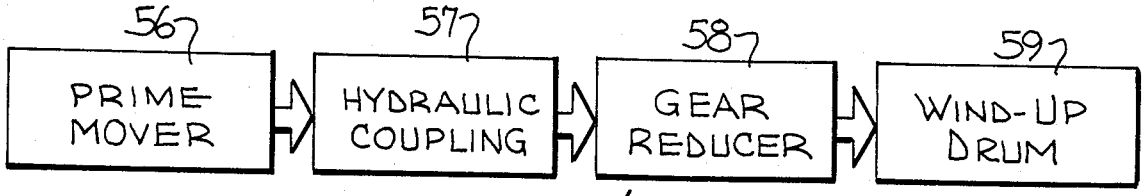
FIG. 8 is a schematic diagram of the power system for the apparatus.

The cable 40 runs over a pulley 54 adjacent the discharge end, and then downwardly to the power package 55, which is located at ground level. As schematically illustrated in FIG. 8, the power package 55 includes a prime mover 56, such as an electric or gasoline motor, having a reversible output. A hydraulic coupling 57 is connected to the output of the motor, a gear reducer 58 is connected to the output of the coupling, and a windup drum 59 is connected to the output of the gear reducer and has one end of the cable 40 wound thereupon. The gear reducer 58 has a sufficiently high gear reduction ratio so that it acts as a brake to prevent inadvertent downward movement of the container along the trackway, and the hydraulic coupling 57 serves to cushion the shock of both the starting and stopping operations.

To facilitate loading of the ingredients into the container at the receiving end portion, a guide chute 61 or hopper may be separately mounted so as to overlie the opened door 32 of the container. A similar guide chute 62 may be mounted to the framework below the container at the discharge end portion for guiding the contents into an underlying truck bed or the like.

In operation, the prime mover 56 is operated so as to initially position the container on the receiving end portion 15 of the trackway 12, with the brackets 24 engaging the axles 35 so as to permit the cable 40 to become slack. Thus the entire weight of the container is supported by the separate portion 18 of the framework and is monitored by the scale 19. Next, the doors 32 are opened by operation of the motors 33, and the various materials are loaded into the container, with the scale providing a read out of the weight of each material as it is being added. When the desired amounts of all materials are received, the doors 32 are closed and the prime mover 56 is actuated to wind the cable 40 upon the drum 59 and thereby pull the container 26 upwardly along the trackway 12. As it moves, a rolling motion is imparted by the interengagement of the pinion wheels 37 with the toothed racks 20, and the container is rotated about the central axis, to effect mixing of the ingredients. Also, as the container 26 moves up the trackway 12, the reel 42 on the one axle 35 will pay out the electrical cable 44 into the underlying U-shaped trough 22. During such upward movement, the self-centering D-ring 50 serves to transmit the pulling force substantially equally to both axles 35, and in a manner which avoids canting movement.

As noted above, the number of turns of revolution may be controlled by the design diameter of the pinion wheels 37. Also, additional mixing may also be obtained during operation of the apparatus by alternately reversing the direction of the prime mover 56, so that the container alternately moves back and forth along the trackway for a period of time. By design, when the container reaches the discharge location, the door 32 is located on the underside of the container 26, and thus the door may be opened to discharge the mixed contents through the chute 62 and directly into an underlying truck bed or the like. The stop brackets 25 are positioned so as to engage either the arm 52 or the axles 35 and prevent further upward movement in the event the container should inadvertently move beyond the discharge location.

In the drawings and specification, there has been set forth a preferred embodiment of the invention, and although specific terms are employed, they are used in a generic and descriptive sense only and not for purposes of limitation.

That which is claimed is:

1. An apparatus for weighing, mixing, and transporting a mixture of dry granular or wet materials, and which is characterized by the materials being simultaneously mixed and transported, and comprising a trackway including a pair of parallel, laterally spaced apart rails, with said trackway defining a receiving end portion and a discharge end portion, and with said receiving end portion being physically unconnected to the remaining portions of said trackway, a mixing container adapted for receiving the materials to be mixed and including a peripheral outer wall comprising a plurality of flat wall sections, opposite parallel end walls, a door positioned in said peripheral outer wall, axle means fixedly mounted to each of said end walls and extending coaxially outwardly therefrom so as to define a central axis, and wheel means fixedly mounted to each of said axle means and operatively engaging respective ones of said rails of said trackway, and such that the container may be moved along said trackway while being rotated about said central axis, weighing means operatively connected to said receiving end portion of said trackway for permitting the container and its contents to be weighed when said container is disposed on said receiving end portion, means for moving the container along said trackway between said receiving end portion and said discharge end portion, and mixing vane means mounted within said container for facilitating the mixing of the materials during the rotational movement of said container along said trackway, said mixing vane means including a plurality of flat blades mounted in spaced relation to the inside surface of said container outer wall, and with at least a plurality of said wall sections mounting at least one pair of said flat blades, and with the blades of each such pair being separated from each other and oppositely inclined with respect to the axial direction, whereby the container may be filled with weighed amounts of each of plurality of different materials while positioned on said receiving end portion of said trackway, and then moved along the trackway to said discharge end portion to effect concurrent mixing and transport of the materials, and the mixed materials may be discharged upon the container reaching the discharge end portion.

2. The apparatus as defined in claim 1 wherein the length of said trackway is coordinated with the structure of said container such that said door is on the upper side of the container when the container is on said receiving end portion, and said door is on the under side of said container when the container is at said discharge end portion to thereby permit gravity discharge of the materials therefrom.

3. The apparatus as defined in claim 2 further comprising hopper means disposed above said trackway at said receiving end portion for facilitating the loading of materials into the container when the container is positioned on said receiving end portion and said door is opened.

4. The apparatus as defined in claim 3 wherein said trackway is inclined upwardly from said receiving end portion to said discharge end portion and such that the container is elevated at said discharge end portion to permit discharge therefrom into an underlying truck bed or the like.

5. The apparatus as defined in claim 4 wherein each of said rails of said trackway includes a toothed rack, and said wheel means comprises a pinion gear meshing with the teeth of the associated rack.

6. The apparatus as defined in claim 1 wherein said container moving means includes a D-ring rotatably fixed to each of said axle means adjacent each end wall of said container, cable means fixed to said D-ring, and power means for pulling the cable means along the direction of said trackway.

7. The apparatus as defined in claim 6 wherein said power means includes a prime mover, a fluid coupling connected to the output of said prime mover, a gear reducer operatively connected to the output of said fluid coupling, and a wind-up drum connected to the output of said gear reducer and having an end of said cable means wound thereupon, and such that the fluid coupling acts to effectively preclude start or stop shocks to the container, and the gear reducer acts as a brake to prevent inadvertent movement of the container along said trackway.

8. The apparatus as defined in claim 1 further including a U-shaped trough disposed along one of said rails, a reel fixed to one of said axle means of said container so as to overlie said trough, and an elongate flexible conduit having one end wound upon said reel such that the cable is unwound from the reel and laid into the trough upon movement of the container in one direction along the trackway and the cable is lifted from the trough and wound onto the reel upon movement in the other direction.

9. The apparatus as defined in claim 8 further including electrical motor means mounted on said container for operatively opening and closing said door, and wherein said conduit is an electrical conduit which is operatively connected to said motor means.

10. The apparatus as defined in claim 1 wherein said container moving means includes a rigid D-ring composed of parallel side arms and a lateral connecting arm which is disposed parallel to said central axis, with said side arms being rotatably connected to respective ones of said axle means, cable means connected to the central portion of said lateral connecting arm of said D-ring, and power means for pulling the cable means along the direction of said trackway, and whereby the force transmitted through said D-ring to each of said axle means is equalized to maintain the container centered along the trackway and avoid the canting thereof.

* * * * *